US012612788B2

(12) United States Patent
Hannig et al.

(10) Patent No.: US 12,612,788 B2
(45) Date of Patent: Apr. 28, 2026

(54) SEEP-RESISTANT PANEL

(71) Applicant: AKZENTA PANEELE + PROFILE GMBH, Kaisersesch (DE)

(72) Inventors: Hans-Jürgen Hannig, Bergisch Gladbach (DE); Egon Hoff, Mastershausen (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 146 days.

(21) Appl. No.: 18/030,544

(22) PCT Filed: Nov. 11, 2021

(86) PCT No.: PCT/EP2021/081333
§ 371 (c)(1),
(2) Date: Apr. 6, 2023

(87) PCT Pub. No.: WO2022/101318
PCT Pub. Date: May 19, 2022

(65) Prior Publication Data

US 2023/0374793 A1 Nov. 23, 2023

(30) Foreign Application Priority Data

Nov. 12, 2020 (EP) ..... 20207229

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 15/02016* (2013.01);
(Continued)

(58) Field of Classification Search
CPC ..... E04F 15/02038; E04F 13/0894; E04F 15/02016; E04F 15/02033;
(Continued)

(56) References Cited

U.S. PATENT DOCUMENTS 8,850,768 B2 10/2014 Hannig
2002/0189183 A1* 12/2002 Ricciardelli ..... E04F 15/02 52/311.1
(Continued)

FOREIGN PATENT DOCUMENTS

CN 102165124 A 8/2011
DE 102014114250 A1 * 3/2016 ..... A61F 5/56
(Continued)

OTHER PUBLICATIONS

International Search Report (English and German) and Written Opinion of the ISA (German) issued in PCT/EP2021/081333, mailed Feb. 11, 2022; ISA/EP.
(Continued)

*Primary Examiner* — Brent W Herring
(74) *Attorney, Agent, or Firm* — Harness, Dickey & Pierce, P.L.C.

(57) ABSTRACT

Disclosed is a panel for covering a surface of a room, having a panel element, which extends in a longitudinal direction and a transverse direction, for transferring use loads introduced from a top side of the panel element to a bottom side of the panel element facing the surface of the room, wherein the top side is spaced from the bottom side in a thickness direction, and having a locking hook, projecting from the panel element in the longitudinal direction, for latching into a receiving groove of another panel, wherein an end face reference plane of an end face of the panel element extending away from the locking hook is inclined relative to the thickness direction, thereby forming an obtuse angle with
(Continued)

the locking hook. The obtuse angle between the locking hook and the end face reference plane allows for a seep-resistant and fracture-proof panel.

17 Claims, 4 Drawing Sheets

(52) U.S. Cl.
CPC . *E04F 15/02033* (2013.01); *E04F 2201/0115* (2013.01); *E04F 2201/0146* (2013.01); *E04F 2201/03* (2013.01); *E04F 2201/042* (2013.01); *E04F 2201/043* (2013.01)

(58) Field of Classification Search
CPC ..... E04F 2201/0146; E04F 2201/042; E04F 2201/043; E04F 2201/0115; E04F 2201/026; E04F 2201/03
USPC ..... 52/588.1
See application file for complete search history.

(56) References Cited

U.S. PATENT DOCUMENTS

2009/0049787 A1 2/2009 Hannig
2010/0031594 A1* 2/2010 Liu ..... E04F 15/02194 52/592.1
2011/0131909 A1* 6/2011 Hannig ..... E04F 15/02 52/309.1
2011/0138722 A1* 6/2011 Hannig ..... E04F 15/02033 52/309.1
2013/0247502 A1* 9/2013 Zhang ..... E04F 15/02038 52/745.13
2013/0309441 A1* 11/2013 Hannig ..... F16B 5/008 29/428
2018/0216353 A1* 8/2018 Hannig ..... E04F 15/02033
2021/0238863 A1 8/2021 Sieder et al.

FOREIGN PATENT DOCUMENTS

DE 102015111930 A1 * 1/2017 ..... E04F 13/0894
DE 202019101807 U1 5/2019
KR 10-2003-0001395 A 1/2003
KR 10-2013-0121131 A 11/2013
WO WO-01/75247 A1 10/2001
WO 2004081316 A1 9/2004
WO 2006133690 A1 12/2006

OTHER PUBLICATIONS

Jan. 7, 2025 Notice of Grounds for Rejection issued in Korean Patent Application No. 10-2023-7013913.
Jun. 7, 2025 Notice of First Office Action issued in Chinese Patent Application No. 2025060700007390.

* cited by examiner

SEEP-RESISTANT PANEL

CROSS-REFERENCE TO RELATED APPLICATIONS

This application is a U.S. National Phase Application under 35 U.S.C. 371 of International Application No. PCT/EP2021/081333, filed on Nov. 11, 2021, which claims the benefit of European Patent Application No. 20207229.4, filed on Nov. 12, 2020. The entire disclosure of the above European patent application is incorporated herein by reference.

FIELD

The disclosure relates to a panel with a high seep-resistance with respect to penetration of liquids at a bottom side of the panel, which, with the aid of further such panels, can cover a surface of a room, in particular in order to thereby improve the visual appearance of the room and/or to conceal the surface of the room with a material layer which is more suitable for the intended function.

BACKGROUND

This section provides background information related to the present disclosure which is not necessarily prior art.

From WO 2006/133690 A1 a panel is known which can be interlocked at the end face with a correspondingly shaped further panel via a locking hook latching into a receiving groove of the further panel, wherein in a thickness region outside the locking hook, a joint plane extending perpendicular to the longitudinal direction of the panel and perpendicular to the transverse direction of the panel is formed, from which joint plane two receiving pockets of different depths extend perpendicularly in the longitudinal direction of the panel for receiving corresponding projecting latching bumps of the further panel, and two latching bumps of different height project for engaging into corresponding receiving pockets of the further panel.

There is a constant need to design the connection of panels to be as seep-resistant and fracture-proof as possible.

SUMMARY

This section provides a general summary of the disclosure, and is not a comprehensive disclosure of its full scope or all of its features.

It is the object of the disclosure provide measures that enable a panel to be made seep-resistant and/or fracture-proof.

One embodiment relates to a panel for covering a surface of a room, comprising a panel element extending in a longitudinal direction and a transverse direction for transferring use loads introduced at a top side of the panel element to a bottom side facing the surface of the room, wherein the top side is spaced from the bottom side in a thickness direction, and a locking hook projecting from the panel element in the longitudinal direction for latching into a receiving groove of another panel, wherein an end face reference plane of an end face of the panel element extending away from the locking hook is inclined with respect to the thickness direction, thereby forming an obtuse angle with the locking hook.

The panel may comprise a panel element based on a cuboid as a basic shape, the longitudinal extension of which is generally significantly greater than its transverse extension, while the thickness of the panel element in the thickness direction is generally smaller than its transverse extension. At the one long side extending in the longitudinal direction, the panel element may comprise a bung extension extending in particular continuously in the longitudinal direction and projecting in the transverse direction, and on the other side may comprise a bung groove formed in the panel element in the transverse direction, so that essentially identically designed panels can be connected to one another abutting at the long sides by means of a tongue-and-groove connection configured in the form of a bung. In addition, the locking hook can protrude in the longitudinal direction from the transversely extending short side of the panel element, while a tongue body can protrude from the other short side of the panel element, which delimits a receiving groove, so that substantially identically configured panels can also be latched together at their short sides via a tongue-and-groove connection. During assembly, the one panel can be laid flat on a subsurface defining a plane of use, for example a floor, a side wall or a ceiling of a room. The other panel can, if necessary, be placed for example slightly inclined at an angle of approximately 30° with an already mounted panel extending laterally next to the panel at the long side and then swiveled onto the subsurface, whereby the tongue-and-groove connection between the locking hook of the panel and the receiving groove of the other panel can be realized.

The locking hook usually rests on a subsurface defined by the surface of the room and is supported by the subsurface. However, it has been recognized that the locking hook is susceptible to fracture at the transition to the panel element. It is assumed that when the tongue-and-groove connection between the locking hook of the panel and the receiving groove of the other panel is produced, due to the slightly inclined alignment of the other panel to the subsurface the locking hook can lift off somewhat from the subsurface at least at the last latching area at the end of the swivelling movement of the other panel and can thus be bent elastically relative to the panel element, which in the case of excessive bending of the locking hook can lead to a damage in the transition area between the locking hook and the panel element. However, since the locking hook does not form a right angle with respect to the end face reference plane at the short side of the panel element, but rather an obtuse angle, notching effects in the transition of the locking hook, which is in particular formed integrally with the panel element, can at least be reduced. This, in turn, increases the bendability and elasticity of the connection of the locking hook to the panel element, so that the locking hook can be bent to a greater extent around a bending axis extending substantially in the transverse direction compared to a perpendicular protrusion from the panel element without breaking or otherwise being damaged. The end face reference plane can be aligned inclined to a plane formed by the thickness direction and the transverse direction and can be aligned in particular tilted to this plane at least proportionally about a tilt axis extending in the transverse direction. Instead of achieving an improved fracture resistance by increasing the stability or hardness of the areas at risk of fracture, an improved fracture resistance is achieved by increasing the elasticity in the areas at risk of fracture. Here, the knowledge is exploited that the locking hook can be clamped in the mounted state between the surface of the room to be concealed and the further panel, so that an increased bendability does not have a detrimental effect on the functional use. Due to the obtuse angle between the locking hook and the end face reference plane of the panel element, the fracture resistance of the locking hook under bending load is improved, so that a fracture-proof connectable panel is enabled.

Since the end face reference plane can be oriented at an angle to a plane spanned by the thickness direction and the transverse direction, the distance that a liquid had to move from the top of the panel element to the locking hook and up to the bottom side of the panel element can be extended compared to an end face reference plane lying in the plane spanned by the thickness direction and the transverse direction. The risk that a liquid reaches the bottom side of the panel element, remains there and promotes the formation of mold, is thereby at least reduced. Due to the longer distance for the liquid to reach the locking hook a larger volume of the liquid can be retained, in particular by capillary forces, in a joint bounded by the end faces of interlocked panels, so that this volume of liquid can evaporate at a later time and leave the joint again without being retained at the bottom side of the panel element. The inclination of the end face reference plane prevents or at least reduces the liquid from seeping up to the bottom side of the panel element, so that the seep-resistance of the panel is improved compared to a non-inclined end face reference plane. The obtuse angle between the locking hook and the end face reference plane enables a seep-resistant and fracture-proof panel.

If the end face of the panel element should be designed as a flat surface at the short side of the panel element, the end face coincides with the end face reference plane. However, it is possible to design the end face of the panel element different from a flat surface, so that the end face reference plane corresponds to the plane of the panel element at the short side, if the deliberately provided unevennesses of the end face is assumed away. For example, the end face of the panel element can initially be designed to be flat and only be deliberately designed to be uneven in a later shaping step, so that the end face reference plane would correspond to the end face before the shaping step. In particular, if the end face is designed uneven only in partial areas, the remaining flat partial areas, at least in the vicinity of the locking hook, correspond to corresponding partial areas of the end face reference plane. Any edge smoothings provided by chamfers in the transition area between the end face and the top side of the panel element are not taken into account in determining the orientation of the end face reference plane. If the entire end face of the panel element would be designed uneven, the end face reference plane can be defined by a centerline of the cross-section, as viewed in the transverse direction, of the panel element from which the elevations and depressions of the uneven end face protrude, provided that the sum of the cross-sectional areas, as viewed in the transverse direction, of the elevations is equal to the sum of the cross-sectional areas, as viewed in the transverse direction, of the depressions.

The panel element may comprise a core based on a wood material, which can be provided with a decorative layer, in particular at the top side facing away from the subsurface. The decorative layer may in particular be made of a material that is harder and/or more resistant than the core and/or may be provided with a preferably substantially transparent and/or translucent protective layer. This enables the decorative layer to withstand appropriately mechanical stresses but also other stresses, such as those caused by moisture and/or cleaning agents, while the core, which is softer compared to the decorative layer, can dampen vibrations, in particular impact sound. The bottom side of the panel element can be laid directly onto the surface of the room to be covered. Alternatively, the panel element can be supported indirectly, for example via an anti-slip film and/or anti-squeak film arranged between the bottom side of the panel element and the surface of the room. In particular, if the panel is to be used to cover a ceiling of a room, the panel may be bonded via spacers. The locking hook can protrude from the panel element by means of a longitudinally extending web, at the free end of which a material thickening is formed which can hook into the receiving groove of the further panel in a form-fitting manner. The material thickening can be moved past the tongue body during establishing the tongue-and-groove connection with the further panel. Here, in particular, the material thickening of the locking hook can slide along the material of the tongue body so that the material thickening of the locking hook can snap into the receiving groove of the further panel when the designated end position for the tongue-and-groove connection is achieved. In particular, the panel and the further panel are designed substantially identical to each other, so that the explanations with respect to the panel can also apply to the further panel and the explanations for the further panel can also be applied to the panel analogously, wherein the locking hook is provided at the one short side and the receiving groove is provided at the other short side.

The seep resistance of the panel can be measured by filling a liquid, in particular water, with a predefined specific volume into a vessel open at the bottom and top, so that a defined filling level is obtained for the liquid in the vessel with a defined hydrostatic pressure resulting therefrom. The vessel filled with the liquid is placed centrally on a joint between two panels latched together on the top sides of the two panels. The level of liquid remaining in the vessel after a predefined time is a measure of the seep-resistance to penetration of the liquid into the joint formed between the interlocked panels.

In particular, it is envisaged that the obtuse angle between the locking hook and the end face reference plane is constant in the transverse direction or varies with a constant slope. If the obtuse angle formed between the locking hook and the end face reference plane is essentially the same in each cross-sectional plane along the transverse direction, the panel can be manufactured particularly easily and cost-efficiently. Alternatively, it is also possible in principle that the end face reference plane is additionally chamfered about an axis extending in the thickness direction. The distance for penetrating liquid is thus further extended, which further improves the seep resistance. In addition, it is possible to adapt the bendability of the locking hook in the transverse direction to the forces occurring during interlocking with the other panel. Here, it can be taken into account that the further panel can be swivelled from an inclined position towards the surface of the floor in order to establish the tongue-and-groove connection between the locking hook and the receiving groove, so that during the swivelling movement load profiles applied to the locking hook changing in the transverse direction can arise. For example, the obtuse angle between the locking hook and the end face reference plane can be smaller at the beginning of the swivelling movement of the further profile, in particular at the side facing the long side with the bung extension, than at the end of the swivelling movement of the further profile, in particular at the side facing the long side with the bung groove. As a result, the locking hook can be more immobile and brittle at the beginning of the swivelling movement of the further panel occurring in the establishment of the tongue-and-groove connection in order to facilitate threading of the locking hook, which is already clamped between the surface of the room and the further panel, into the receiving groove, while the bendability of the locking hook increases towards the end of the swivelling movement, although the risk of the locking hook lifting off the surface of the room also increases. In order to form an obtuse angle between the locking hook and the end face reference plane which changes continuously in the transverse direction, the end face reference plane can be oriented rotated about an axis extending in the thickness direction compared to an orientation of the end face reference plane in which the obtuse angle remains constant in the transverse direction. In this case, preferably at the top side of the panel element an edge of the end face extending substantially only in the transverse direction is formed, while in a transition area to the locking hook the end face reference plane extends inclined with respect to the transverse direction. Although the end face reference plane can be oriented tilted about two axes with respect to a rectangular arrangement, at top side facing the interior of the room to be cladded of a plurality of identically shaped panels connected to each other only joints extending perpendicular to each other are recognizable, if at all, so that a visual impairment of a laying pattern by visible edges extending at an angle to one another is avoided. Alternatively, the end face edge of the panel element can be deliberately extend inclined with respect to the longitudinal direction by means of a corresponding angled form of the end face reference plane, for example in order to form visible edges extending parallel and/or perpendicular with respect to a slope in the case of cladding a side wall of a room adjoining a slope.

Preferably, a support surface of the locking hook facing the further panel merges into the end face via a rounding. A sharp-edged transition between the locking hook and the end face of the panel element is avoided, which at least reduces notching effects. In this case, the obtuse angle exceeding 90° between the locking hook and the end face reference plane is maintained by the fact that the rounding has an extension over an angular range of less than $\pi/2$ between the support surface and the end face reference plane and thus forms a correspondingly shallower transition. The rounding can be part of a circular arc, wherein a surface normal of an associated imaginary circle points in particular essentially or at least to a large part in the transverse direction. However, it is also possible that the rounding is part of an arc of an ellipse or is irregularly rounded.

Particularly preferably, the rounding forms part of a receiving pocket extending from the end face reference plane for receiving a protruding latching bump of the further panel. The receiving pocket can extend from the end face reference plane in the proximal direction, i.e. towards the center of gravity of the panel element, while the latching bump protrudes in the distal direction, i.e. away from the center of gravity of the panel element. The receiving pocket and/or the latching bump may be formed from the core of the respective panel element. In particular, the receiving pocket is bounded by a wood material and/or the latching bump is formed by a wood material. The latching bump and the receiving pocket are thereby, in particular compared to a decorative layer of the panel element, made of a rather soft material, so that the latching bump can be pressed into the receiving pocket during the production of the tongue-and-groove connection between the locking hook and the receiving groove. In this case, it may be deliberately permitted that the latching bump and/or the receiving pocket deform elastically and/or plastically so that the latching bump can engage into the receiving pocket in the designated end position. In particular, the latching bump is pressed against the pocket, wherein an elastic and/or plastic deformation of the latching bump and/or the receiving pocket can be permitted in the pressed-on state. The path length for penetrating liquid is further extended by the latching bump engaging into the receiving pocket, which further improves the seep-resistance. The latching bump engaging into the receiving pocket may form together with the receiving pocket at least one labyrinth seal, whereby penetration of liquid and/or moisture into a joint remaining between the interlocked panels may be prevented. The interlocking of the panels with each other can thereby be configured to be substantially waterproof. A suitable design of the receiving pocket and the latching bump is described in WO 2006/133690 A1, the content of which is hereby referred to as part of the disclosure. A center line of a cross-sectional plane, as viewed in the transverse direction, of the receiving pocket and/or the latching bump may be oriented perpendicular to the orientation of the inclined end face reference plane or substantially in the longitudinal direction of the panel element. The rounding formed between the locking hook and the end face may extend beyond the level of the end face reference plane in the proximal direction and simultaneously form an edge of the receiving pocket. The receiving pocket can thus directly adjoin the locking hook. This allows to provide a particularly large number of receiving pockets and/or locking bumps on the remaining height of the end face in the thickness direction, thus improving the sealing effect. At the same time, the particularly elongated rounding improves the bendability and the fracture resistance of the locking hook, so that a panel with a good sealing effect and a good fracture resistance is enabled.

In particular, the end face comprises at least three receiving pockets extending from the end face reference plane respectively for receiving a protruding latching bump of the further panel, wherein in particular the end face comprises at least two latching bumps protruding from the end face reference plane for engaging into the respective corresponding receiving pocket of the further panel. Due to the inclined orientation of the end face reference plane, the total area of the end face can be increased for a given thickness of the panel element. This allows the number of receiving pockets and/or latching bumps to be increased. For example, three receiving pockets with two latching bumps provided therebetween are provided at the end face of the panel element with the locking hook.

Preferably, the end face comprises receiving pockets arranged alternately in the thickness direction and extending from the end face reference plane for receiving a respective projecting latching bump of the further panel and latching bumps projecting from the end face reference plane for engaging into a respective corresponding receiving pocket of the further panel, wherein, in at least one cross-sectional plane in the transverse direction, the receiving pockets merge directly into the latching bumps, in particular only via one inflection point of a cross-sectional profile of the end face lying in the end face reference plane. In the case of a cross-sectional plane, as viewed in the transverse direction, the receiving pockets and the latching bumps can swivel around the end face reference plane as a center line, preferably with the same amplitude. In particular, no plateau lying in the end face reference plane is provided between the receiving pocket and the latching bump following in the direction of thickness, so that the receiving pocket merges into the latching bump in particular essentially without a step. The orientation of the end face reference plane can be found here by the points of inflection lying in an imaginary straight line of the extension of the end face in the cross-sectional plane, as viewed in the transverse direction. The points of inflection arise in the stepless transition between the receiving pocket and the latching bump. Due to the corrugated extension of the end face in the thickness direction, which is provided in particular over the entire extension from the locking hook and an edge-smoothing chamfer, a particularly large number of receiving pockets and latching bumps can be formed, whereby a waterproof and/or seep-resistant seal can be achieved and/or improved at the end faces of the panels.

Particularly preferred the obtuse angle $\alpha$ is $90° < \alpha \leq 115°$, in particular $91° \leq \alpha \leq 105°$, preferably $92° \leq \alpha \leq 100°$ and particular preferably $\alpha = 95° \pm 2°$. Such a chamfer of the end face reference plane can lead to a sufficient bendability of the locking hook and at the same time is still easy to manufacture.

In particular, a tongue body projecting from the panel element in the longitudinal direction is provided for receiving, in particular without play, a locking hook of the further panel which can be latched in a receiving groove formed by means of the tongue body and/or the panel element, wherein an end face reference plane of a tongue end face of the tongue body facing away from the panel element extends at an angle to the thickness direction while forming an acute angle with a contact surface of the tongue body facing the locking hook. The tongue body and the tongue end face reference plane can be designed corresponding to the locking hook and the end face reference plane. This allows identically configured panels to be interlocked with one another in the longitudinal direction one behind the other. Here, the design of the panel at the short side with the tongue body corresponding to the above-described design of the panel at the short side with the locking hook represents an independent embodiment of the disclosure based on the same inventive idea.

A further embodiment of the disclosure relates to a panel for covering a surface of a room, comprising a panel element extending in a longitudinal direction and a transverse direction for transferring use loads introduced at a top side of the panel element to a bottom side of the panel element facing the surface of the room, wherein the top side is spaced apart from the bottom side in a thickness direction, and a tongue body projecting from the panel element in the longitudinal direction for receiving, in particular without play, a locking hook of a further panel which can be locked into a receiving groove formed with the aid of the tongue body and/or of the panel element, wherein a tongue end face reference plane of a tongue end face of the tongue body facing away from the panel element extends at an angle with respect to the thickness direction, while forming an acute angle with a contact surface of the tongue body facing the locking hook.

The panel can be formed and further developed in the region of the tongue body as described above, wherein in particular the region of the tongue body can be formed in corresponding to the panel formed and further developed as described above in the region of the locking hook. The above explanations regarding the panel in the region of the locking hook can analogously apply to the design of the panel in the region of the tongue body. Due to the acute angle between the tongue body and the tongue end face reference plane of the panel element the fracture resistance of the tongue body and/or of the locking hook cooperating with the tongue body under bending load is improved, so that a panel which can be connected in a fracture-resistant manner is made possible. Moreover, the path length for penetrating liquid is further increased, so that the seep-resistance is further improved. Due to the acute angle between tongue body and the tongue end face reference plane of the panel element a seep-resistant and fracture-proof panel is enabled. In particular, the contact surface can abut against a web of the locking hook connecting a material thickening of the locking hook to the panel element or be spaced from the web via an air gap as small as possible. The material thickening of the locking hook can slide against the contact surface of the tongue body in order to be able to snap into the receiving groove. The receiving groove is delimited in particular by a material taper of the tongue body and a part of the end face of the panel element from which the tongue body projects distally in the longitudinal direction. The tongue end face reference plane can be aligned at an angle with respect to a plane spanned by the thickness direction and the transverse direction and, in particular, can be tilted at least proportionally with respect to this plane about a tilt axis extending in the transverse direction. In particular, it is provided that the acute angle between the tongue body and the tongue end face reference plane is constant in the transverse direction or changes with a constant slope. The following explanations apply in common to all of the above independent disclosures.

Preferably, the contact surface of the tongue body merges with the tongue end face via a counter-rounding. A sharp-edged transition between the tongue body and the end face of the panel element is avoided, whereby notching effects are at least reduced. In this case, an acute angle of less than 90° between the contact surface of the tongue body and the tongue end face reference plane is maintained by the fact that the counter-rounding, too, has an extension over an angular range of less than $\pi/2$ between the contact surface of the tongue body and the tongue end face reference plane and forms a correspondingly flatter transition. The counter-rounding can be part of an arc of a circle, wherein a surface normal of an associated imaginary circle points in particular essentially or at least to a large extent in the transverse direction. However, it is also possible that the counter-rounding is part of an arc of an ellipse or is irregularly rounded. In particular, the counter-rounding can fit flush with the rounding formed between the locking hook and the end face of another panel, preferably with a clearance fit.

Particularly preferably, the counter-rounding forms a part of a locking bump projecting from the tongue end face reference plane for engaging into a corresponding receiving pocket of the further panel. A centerline of a cross-sectional plane, as viewed in the transverse direction, of the receiving pocket and/or the latching bump may be oriented perpendicular to the orientation of the inclined tongue end face reference plane or substantially in the longitudinal direction of the panel element. The counter-rounding formed between the tongue body and the end face may extend beyond the level of the tongue end face reference plane in the distal direction while forming an edge of the latching bump. The latching bump can thus adjoin immediately the contact surface of the tongue body. This makes it possible to provide a particularly large number of receiving pockets and/or latching bumps at the remaining height of the end face in the thickness direction, which can improve the sealing effect.

In particular, the tongue end face comprises at least three latching bumps projecting from the tongue end face reference plane for respectively engaging into a corresponding receiving pocket of the further panel, wherein in particular at least two receiving pockets extending from the tongue end face plane are provided for respectively receiving a projecting latching bump of the further panel. Due to the inclined orientation of the tongue end face reference plane, the total surface area of the end face can be increased for a given thickness. This allows the number of receiving pockets and/or latching bumps to be increased. For example, three latching bumps with two receiving pockets provided therebetween are provided at the end face of the panel element with the tongue body.

Preferably, the tongue end face comprises receiving pockets arranged alternately in the direction of the thickness and extending from the tongue end face reference plane for receiving respectively a projecting latching bump of the further panel and latching bumps projecting from the tongue end face reference plane for engaging respectively into a corresponding receiving pocket of the further panel, wherein, in at least one cross-sectional plane in the transverse direction the receiving pockets merge directly, in particular only via one inflection point of a cross-sectional profile of the tongue end face lying in the tongue end face reference plane, into the latching bumps. In the case of a cross-sectional plane, as viewed in the transverse direction, the receiving pockets and the latching bumps can swivel around the tongue end face reference plane as a centerline, preferably with the same amplitude. In particular, no plateau lying in the tongue end face reference plane is provided between the receiving pocket and the latching bump following in the thickness direction, so that the receiving pocket merges into the latching bump in particular essentially without a step. The orientation of the tongue end face reference plane can be found here by the points of inflection of the extension of the tongue end face lying in an imaginary straight line in the cross-sectional plane, as viewed in the transverse direction. The points of inflection arise in the stepless transition between the receiving pocket and the latching bump. Due to the corrugated extension of the tongue end face in the thickness direction, which is in particular provided over the entire extension from the contact surface and an edge-smoothing chamfer, a particularly large number of receiving pockets and latching bumps can be formed, whereby a watertight and/or seep-resistant seal can be achieved and/or improved at the end faces of the panels.

It is particularly preferred that the acute angle ß between the tongue end face reference plane and the thickness direction is $65° \leq \beta < 90°$, in particular $75° \leq \beta \leq 89°$, preferably $80° \leq \beta \pm 88°$ and particularly preferably $\beta = 85° \pm 2°$. Such a chamfer of the tongue end face reference plane can result in a sufficient bendability of the locking hook of the other panel and at the same time is still easy to manufacture. In particular, the angle $\alpha$ and the angle $\beta$ complement each other to 180°, so that $\alpha + \beta = 180°$ is satisfied.

In particular, the receiving groove comprises a first clamping surface and a second clamping surface, in particular extending essentially parallel to the first clamping surface, for clamping the locking hook without play, wherein the first clamping surface is connected to the second clamping surface via an arcuate surface, in particular extending at a distance from the locking hook. A material thickening of the locking hook can be inserted into the receiving groove with a press fit between the clamping surfaces. The arcuate surface allows sufficient clearance to be achieved between the material thickening of the locking hook and a material taper of the tongue body. At the same time, the material taper of the tongue body allows elastic bending of the tongue body in order to make the locking hook snap and latch into the receiving groove similar to a clip connection. The arcuate shape of the arcuate surface, which in particular merges into the clamping surfaces without a step, can reduce notching effects and provide sufficient fracture resistance of the tongue body which bounces when the tongue- and groove connection of the locking hook with the receiving groove is produced. The fracture resistance of the panel is thereby improved.

Preferably, the tongue end face comprises an overlap extension projecting from the tongue end face reference plane for covering a joint which is formed between the tongue end face and the end face of the latched further panel and extends between the overlap extension and the locking hook of the further panel. When the panel is latched at the one end face to the other end face, corresponding to that end face, of a panel of substantially identical shape, a joint can be formed between the respective end faces, i.e. the tongue end face of one panel and the end face of the further panel. This joint can be covered by the overlap extension, so that the visual appearance is improved. A dark or shadowy appearing edge between the interlocked panels can thus be avoided or at least be less pronounced. In addition, the overlap extension can form a further chicane in the manner of a labyrinth seal, which can further improve the seep resistance against liquid penetration into the joint and to the bottom side of the panel.

Particularly preferably, the panel element comprises a core and a decorative layer forming the top side and connected to the core, wherein the core and the decorative layer are made of different materials, and wherein the overlap extension is formed at least partially, in particular completely, from the decorative layer. The surface of the overlap extension facing away from the bottom side of the panel element can thus be formed from the decorative layer and can continue the visual appearance of the decorative layer beyond the joint. This makes it possible to manufacture the core from a particularly durable material, for example, without restricting the choice of material for the core by requirements relating to visual effect. If there is a color change between the core and the decorative layer, this can be covered and laminated by the overlap extension so that the color change is no longer visible. A change in visual appearance between the decorative layer with the overlap extension and the decorative layer of the further panel can be substantially avoided or significantly reduced compared to a change in visual appearance between the decorative layer and the core.

In particular, the overlap extension is configured such that the overlap extension is pressed against the further panel with a pressing force in a latched state of the panel with the further panel. The protruding overlap extension can be bent somewhat, comparable to a bending spring, when the panel is latched to the further panel, so that the overlap extension can abut pressed against the panel, in particular against the decorative layer and/or at the end face of the further panel with the spring force as a pressing force resulting from the elastic bending. A gap between the overlap extension and the further panel can be avoided or at least reduced, so that a good, in particular virtually jointless, optical appearance is obtained.

Preferably, the overlap extension is designed in such a way that the overlap extension forms a lip seal in a state in which the panel is latched to the further panel. The lip seal formed between the overlap extension and the further panel can be designed in particular in a contacting or a contactless manner. The overlap extension can extend in particular over the entire extension of the panel in the transverse direction or slightly less. The overlap extension can preferably abut against the further panel over its entire extension in the transverse direction of the panel, in particular substantially linearly, and thereby form a contacting lip seal. The sealing effect of the lip seal can be dimensioned such that liquids, in particular water, are retained or the passage of this liquid is at least significantly delayed. As a result, the seep resistance is further improved.

DRAWINGS

The drawings described herein are for illustrative purposes only of selected embodiments and not all possible implementations, and are not intended to limit the scope of the present disclosure.

In the following, the disclosure will be explained by way of example with reference to the accompanying drawings based on preferred exemplary embodiments, wherein the features shown below may each individually or in any combination represent an aspect of the disclosure. In the figures.

Corresponding reference numerals indicate corresponding parts throughout the several views of the drawings.

DETAILED DESCRIPTION

Example embodiments will now be described more fully with reference to the accompanying drawings.

Figure 1:
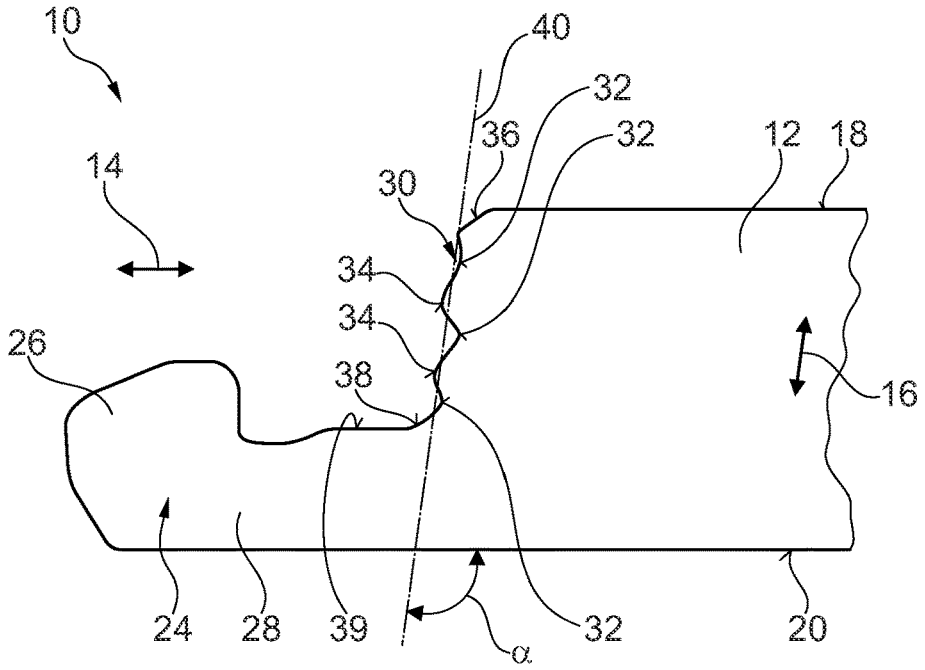
FIG. 1 is a schematic side view of an end face of a panel.

The panel 10 shown in FIG. 1 can be used in particular for covering a surface of a room. For this purpose, the panel 10 comprises a panel element 12 based on a cuboid shape, which has long sides extending in the longitudinal direction 14 and short sides extending in the transverse direction and a thickness extending in the thickness direction 16. The long sides and the short sides delimit a top side 18 and a bottom side 20 of the panel element 12, which are spaced apart from one another via the thickness of the panel element 12 and, in particular, extend parallel to one another. A locking hook 24 formed integrally with the panel element 12 projects from the short side of the panel element 12 in the longitudinal direction 14, wherein the locking hook 12 has a material thickening 26 spaced from the panel element 12 via a web 28. A bottom side of the locking hook 24 facing away from the material thickening 26 in the thickness direction can be connected to the bottom side 20 of the panel element 12 without a step and merge into the latter.

Adjacent to the web 28 of the locking hook 24 is an end face 30 at the short side of the panel element 12, which in the illustrated exemplary embodiment is irregularly shaped in order to increase the seep resistance against penetrating liquid. The end face 30 comprises receiving pockets 32 and latching bumps 34 alternately arranged in the thickness direction. In the exemplary embodiment shown in FIG. 1, three receiving pockets 32 and two latching bumps 34 are provided, which merge into one another essentially without a step and without a plateau formed therebetween, resulting in a corrugated cross-sectional profile for the end face 30. The end face 30 terminates near the top side 18 of the panel element 12 at an edge-smoothing chamfer 36 and merges in the region of the connection of the locking hook 24 via a rounding 38 into a bearing surface 39 of the web 28. The rounding 38 here simultaneously forms a part of the receiving pocket 32 adjoining the locking hook 24.

The cross-sectional profile of the end face 30 can oscillate about a centerline that defines an end face reference plane 40 for the end face 30. If the end face 30 would not comprise receiving pockets 32 and latching bumps 34, the end face 30 would coincide with the end face reference plane 40. In the illustrated exemplary embodiment, the orientation of the end face reference plane 40 may be determined by the inflection points of the cross-sectional profile of the end face 30 formed in the transition between successive receiving pockets 32 and latching bumps 34 and lying in the end face reference plane 40. The end face reference plane 40 is not oriented perpendicular to the top side 18 and to the bottom side 20, but is oriented somewhat inclined to the thickness direction 16, so that an obtuse angle $\alpha$ of more than 90° is formed between the web 28 of the locking hook 24 and the end face reference plane 40. Due to the obtuse angle $\alpha$ and the rounding 38 having an arc length of below $\pi/2$, notching effects can be reduced and a bending elasticity of the locking hook 24 can be increased, thereby reducing the risk of a mechanical damage to the locking hook 24.

Figure 2:
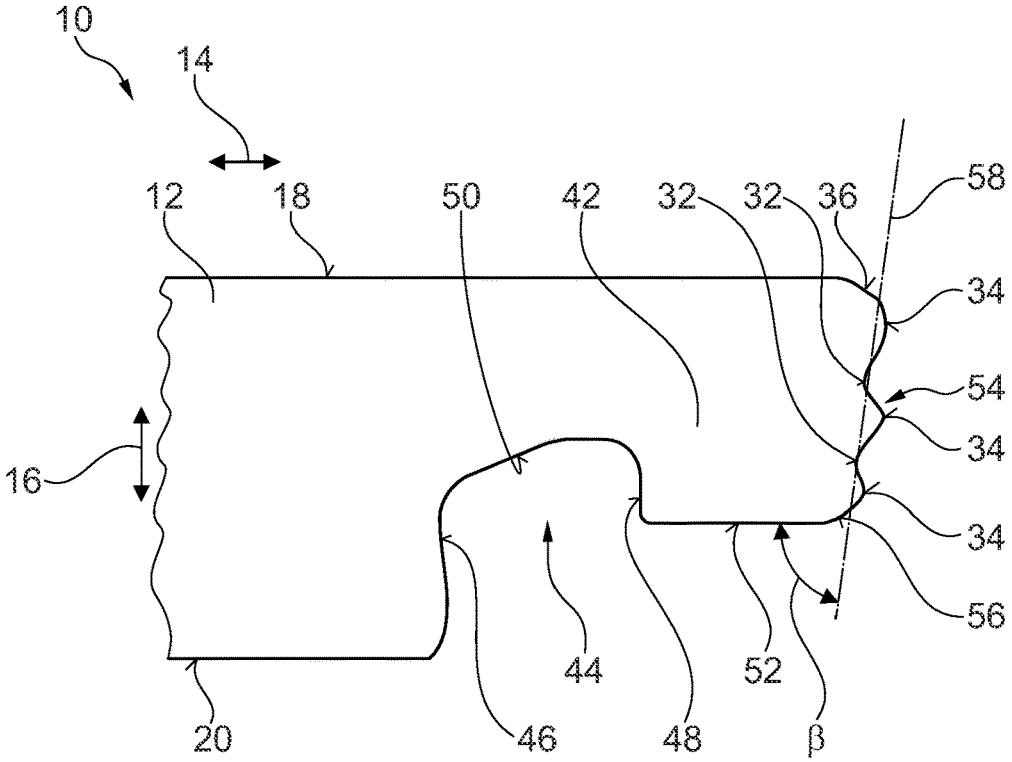
FIG. 2 is a schematic side view of an opposite end face of the panel of FIG. 1.

As shown in FIG. 2, the panel 10 may be configured correspondingly at the opposite short side so that substantially identically configured panels may be interlocked with one another via a tongue-and-groove connection at their end faces. A tongue body 42, which can be elastically bent away from the locking hook 24 of another 5 panel 10, can protrude in the longitudinal direction from the panel element 12, wherein the tongue body forms a receiving groove 44 for receiving the material thickening 26 of the locking hook 24 between the panel element 12 and the tongue body 42 formed integrally with the panel element 12. The receiving groove 44 can be delimited at the one side by a first clamping surface 46 of the panel body 12 and at the other side by a second clamping surface of the tongue body 42, wherein the material thickening 26 of the locking hook 24 can be clamped between the clamping surfaces 46, 48, in particular by means of a press fit. The clamping surfaces 46, 48 can be connected to one another via an arcuate surface 50 of the tongue body 42 extending at a distance from the material thickening 26 inserted into the receiving groove 44. The tongue body 42 may have a contact surface 52 facing to the bearing surface 39 of the web 28 of the locking hook 24, which can form a stop acting in the thickness direction 16 for the tongue-and-groove-connection formed by the locking hook 24 inserted into the receiving groove 42. In the finally interlocked state, a clearance may exist between the contact surface 52 of the tongue body 42 and the bearing surface 39 of the web 28 of the locking hook 24.

The tongue body 42 comprises a tongue end face 54 facing the end face 30 of the panel element 12 which is also irregularly shaped. The tongue end face 54 comprises receiving pockets 32 and latching bumps 34 arranged alternately in the thickness direction, wherein two receiving pockets 32 and three latching bumps 34 are provided in the exemplary embodiment shown in FIG. 2, which merge into one another essentially without a step and without a plateau formed therebetween. The tongue end face 54 also terminates near the top side 18 of the panel element 12 at an edge-smoothing chamfer 36 and merges via a counter-rounding 56 into the contact surface 52.

Similar to the shaping of the end face 30, the cross-sectional profile of the tongue end face 54 may oscillate about a centerline that defines a tongue end face reference plane 58 for the tongue end face 54. If the tongue end face 54 would not comprise receiving pockets 32 and latching bumps 34, the tongue end face 54 would coincide with the tongue end face reference plane 58. In the illustrated exemplary embodiment, the orientation of the tongue end face reference plane 58 can be determined by the points of inflection of the cross-sectional profile of the tongue end face 54 which are formed in the transition between the successive receiving pockets 32 and latching bumps 34 and which lie in the tongue end face reference plane 58. The tongue end face reference plane 58 is not oriented perpendicular to the top side 18 and the bottom side 20 but is slightly inclined to the thickness direction 16, so that an acute angle β of less than 90° is formed between the contact surface 52 and the tongue end face reference plane 40.

Figure 3:
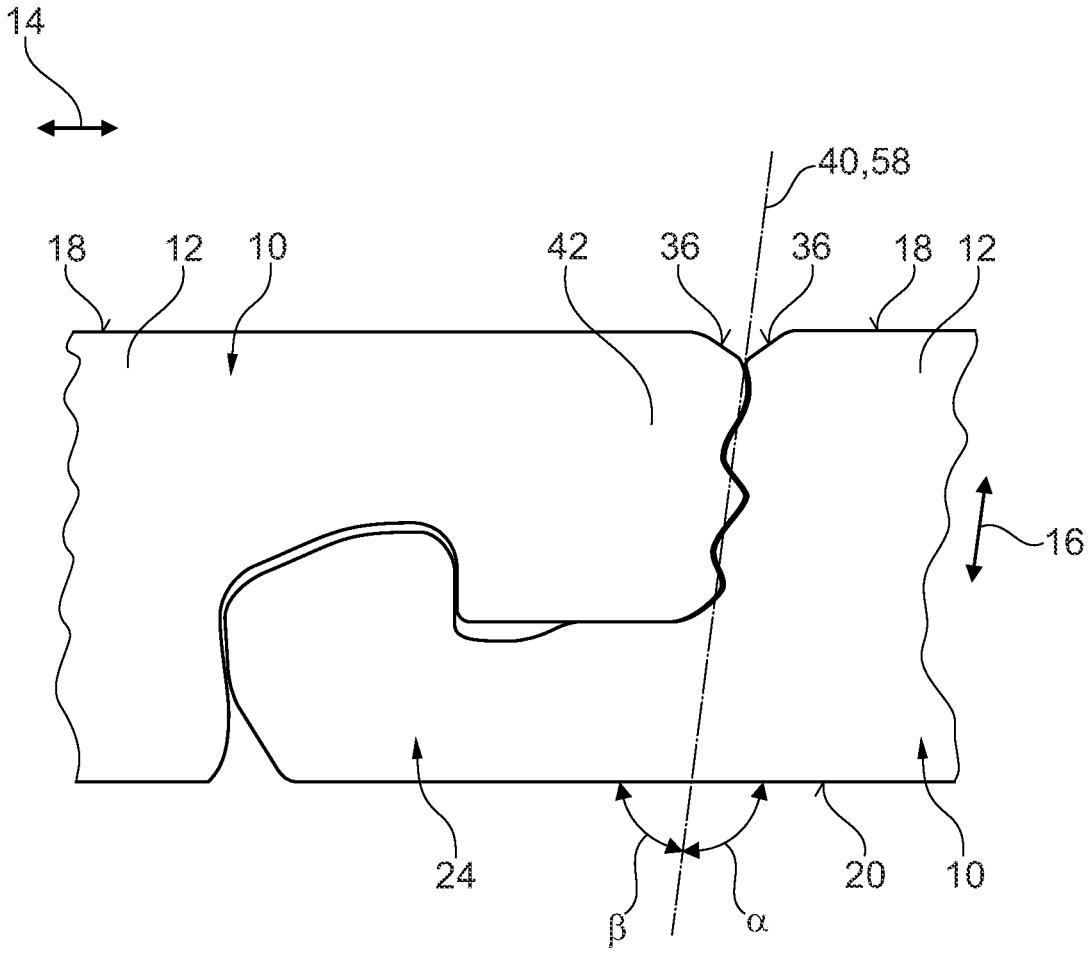
FIG. 3 is a schematic side view of two panels interlocked with each other.

As shown in FIG. 3, the angle α and the angle β complement each other to 180°, so that the end face reference plane 40 of one panel coincides with the tongue end face reference plane 40 of the other panel 10. The respective cooperating receiving pockets 32 and latching bumps 34 of the end face 30 and the tongue end face 54 can here engage into one another elastically and/or plastically deformed and achieve a waterproof seal.

Figure 4:
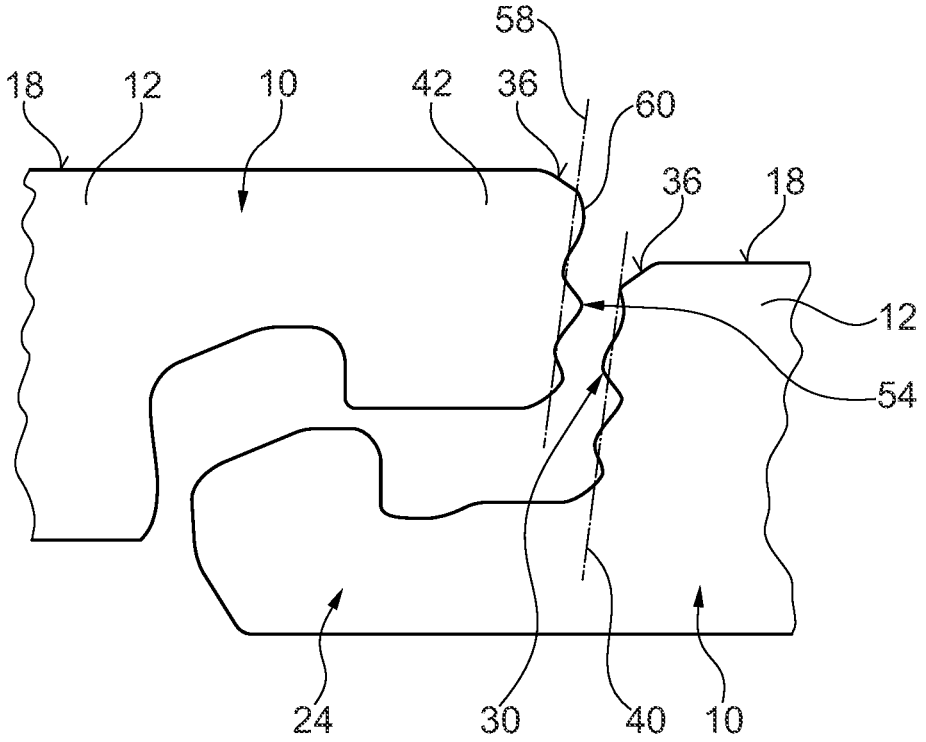
FIG. 4 is a schematic side view of end faces of panels yet to be interlocked with each other according to another embodiment.
Figure 5:
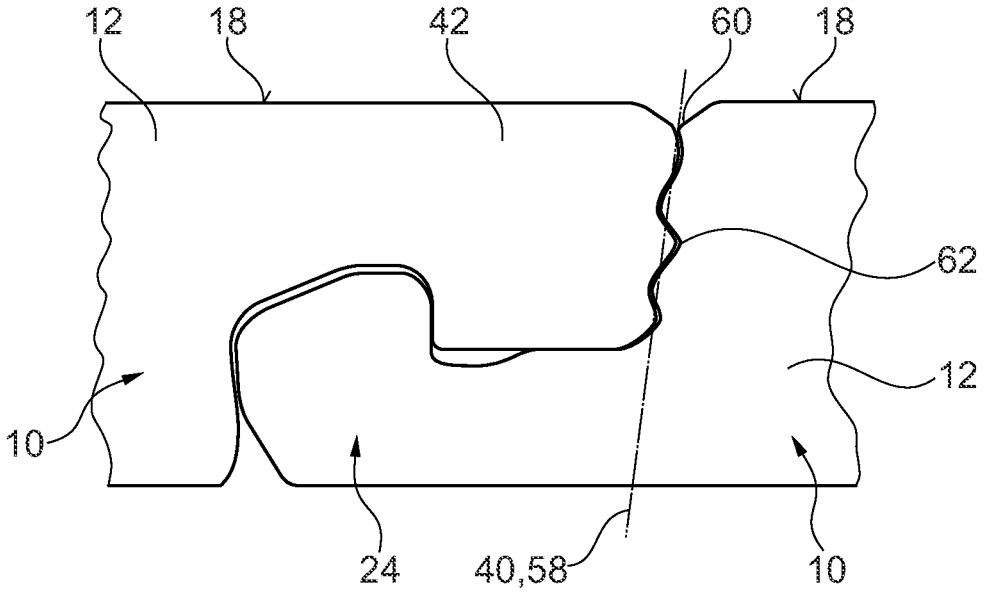
FIG. 5 is a schematic side view of the panels from FIG. 4 in the interlocked state.
Figure 6:
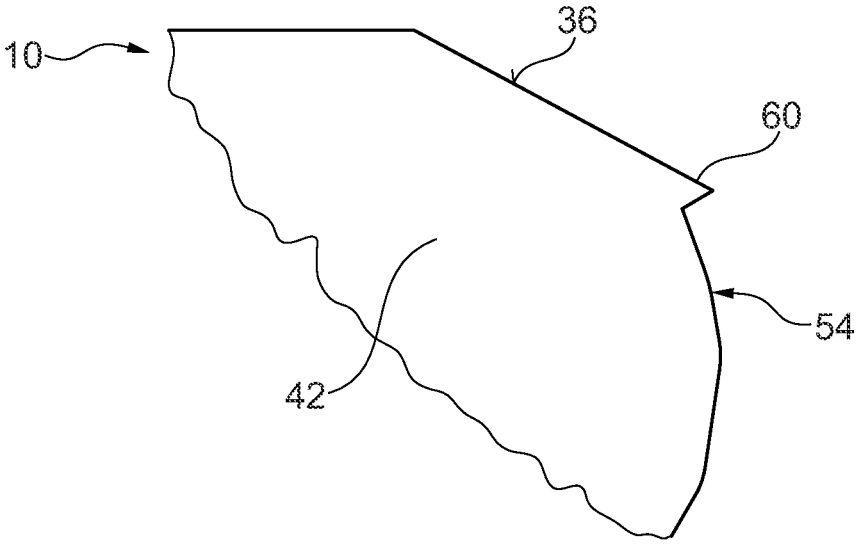
FIG. 6 is a schematic detailed view of a panel from FIG. 4.
Figure 7:
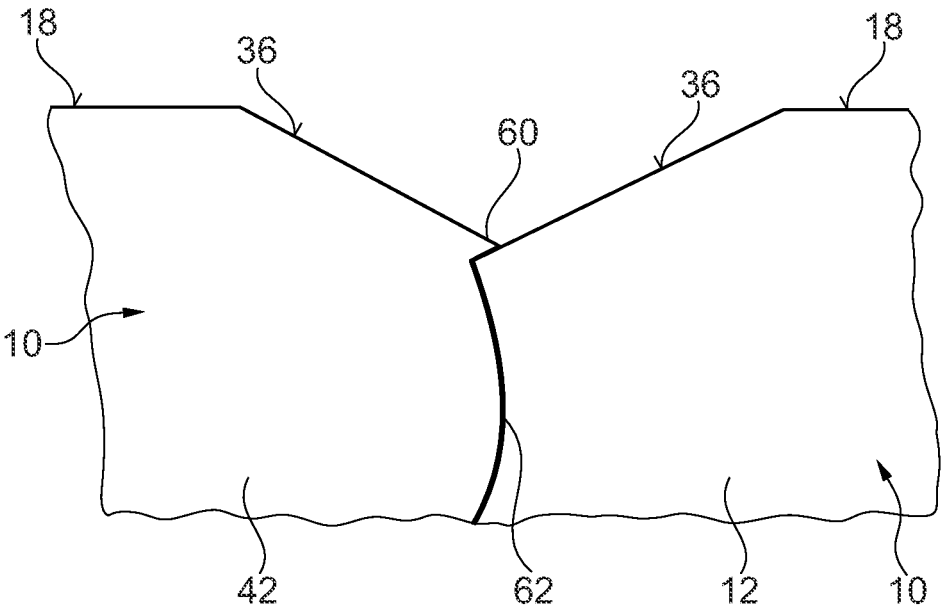
FIG. 7 is a schematic detailed view of the panels from FIG. 5.

The panels 10 shown in FIG. 4 correspond completely to the panels 10 shown in FIG. 3 with the exception that the panel 10 shown on the left side has a protruding overlap extension 60 on its tongue end face 54, which is shown in detail in FIG. 6. In particular, the overlap extension 60 may be formed at the distal lower end of the chamfer 36. Preferably, the chamfer 36 merges without a step into a surface of the overlap extension 60. As shown in FIG. 7, the overlap extension 60 may extend somewhat over the further panel 10, thereby covering a joint 62 formed between the tongue end face 54 of the panel 10 and the end face 30 of the further panel 10. As shown in FIG. 7, the overlap extension 60 can be pressed against the further panel 10, in particular against the chamfer 36 of the further panel 10 and form a lip seal. The overlap extension 60 and the optionally provided chamfer 36 can in particular be part of a decorative layer applied to a core of the panel element 12, so that the overlap extension 60 can also conceal a color change between the decorative layer and the core occurring in the joint 62.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A panel for covering a surface of a room, comprising:

a panel element extending in a longitudinal direction and in a transverse direction for transferring use loads introduced at a top side of the panel element to a bottom side of the panel element facing the surface of the room, wherein the top side is spaced apart from the bottom side in a thickness direction; and a locking hook projecting from the panel element in the longitudinal direction for latching into a receiving groove of a second panel, wherein an end face reference plane of an end face of the panel element extending away from the locking hook extends obliquely in the thickness direction while forming an obtuse angle with the locking hook, and wherein the obtuse angle between the locking hook and the end face reference plane is constant in the transverse direction and wherein the end face reference plane is oriented rotated about an axis extending in the thickness direction relative to an orientation of the end face reference plane in which the obtuse angle remains constant in the transverse direction, and wherein the end face comprises end face receiving pockets arranged alternately in the thickness direction and extending from the end face reference plane, said end face receiving pockets are capable of receiving projecting second panel latching bumps of the second panel, and wherein the end face comprises latching bumps projecting from the end face reference plane, said end face latching bumps being capable of engaging into corresponding second panel receiving pockets of the second panel, wherein in at least one cross-sectional plane in the transverse direction of said panel the end face receiving pockets merge directly into the end face latching bumps only via one inflection point of a cross-sectional profile of the end face lying in the end face reference plane, wherein the obtuse angle α is $92° < \alpha \leq 100°$.

2. A panel for covering a surface of a room, comprising:

a panel element extending in a longitudinal direction and in a transverse direction for transferring use loads introduced at a top side of the panel element to a bottom side of the panel element facing the surface of the room, wherein the top side is spaced apart from the bottom side in a thickness direction; and a locking hook projecting from the panel element in the longitudinal direction for latching into a receiving groove of a second panel, wherein an end face reference plane of an end face of the panel element extending away from the locking hook extends obliquely in the thickness direction while forming an obtuse angle with the locking hook, and wherein the obtuse angle between the locking hook and the end face reference plane remains constant in the transverse direction, and wherein the end face comprises end face receiving pockets arranged alternately in the thickness direction and extending from the end face reference plane, said end face receiving pockets are capable of receiving projecting second panel latching bumps of the second panel, and wherein the end face comprises end face latching bumps projecting from the end face reference plane, said end face latching bumps are capable of engaging into corresponding second panel receiving pockets of the second panel, wherein in at least one cross-sectional plane in the transverse direction the end face receiving pockets merge directly into the end face latching bumps only via one inflection point of a cross-sectional profile of the end face lying in the end face reference plane, wherein the obtuse angle α is $92° < \alpha \leq 100°$.

3. The panel according to claim 2, wherein a bearing face of the locking hook facing the second panel merges into the end face via a rounding.

4. The panel according to claim 2, wherein the end face receiving pockets comprise at least three receiving pockets extending from the end face reference plane capable of receiving the projecting second panel locking bumps of the second panel, wherein the end face locking bumps comprise at least two locking bumps projecting from the end face reference plane capable of engaging into corresponding second panel receiving pockets of the second panel.

5. The panel according to claim 1, wherein a bearing face of the locking hook facing the second panel merges into the end face via a rounding, wherein in at least one cross-sectional plane in the transverse direction the receiving pockets merge directly into the latching bumps only via one inflection point of a cross-sectional profile of the end face lying in the end face reference plane.

6. The panel according to claim 5, wherein the rounding forms a part of a receiving pocket extending from the end face reference plane capable of receiving projecting second panel latching bumps of the second panel.

7. The panel according to claim 1, wherein the end face receiving pockets comprise at least three end face receiving pockets extending from the end face reference plane capable of receiving the projecting second panel locking bumps of the second panel, wherein the end face locking bumps comprises at least two end face locking bumps projecting from the end face reference plane capable of engaging with corresponding second panel receiving pockets of the second panel.

8. The panel according to claim 1, wherein a tongue body projecting from the panel element in the longitudinal direction is provided for receiving without play, a locking hook of the second panel which can be latched in a receiving groove formed with the aid of the tongue body and/or the panel element, wherein a tongue end face reference plane of a tongue end face of the tongue body facing away from the panel element extends inclined to the thickness direction while forming an acute angle with a contact surface of the tongue body facing the locking hook, and wherein the end face comprises receiving pockets arranged alternately in the thickness direction and extending from the end face reference plane capable of receiving projecting second panel latching bumps of the second panel and latching bumps projecting from the end face reference plane capable of engaging into corresponding second panel receiving pockets of the second panel, wherein in at least one cross-sectional plane in the transverse direction the receiving pockets merge directly into the latching bumps only via one inflection point of a cross-sectional profile of the end face lying in the end face reference plane.

9. The panel according to claim 8, wherein the tongue end face comprises an overlap extension projecting from the tongue end face reference plane for covering a joint formed between the tongue end face and the end face of a latched second panel and extending between the overlap extension and the locking hook of the second panel.

10. The panel according to claim 9, wherein the panel element comprises a core and a decorative layer forming the top side and connected to the core, wherein the core and the decorative layer are made of different materials, wherein the overlap extension is formed at least partially from the decorative layer.

11. The panel according to claim 9, wherein the overlap extension is configured such that the overlap extension is pressed against the second panel with a pressing force in a state in which the panel is latched to the second panel.

12. The panel according to claim 9, wherein the overlap extension is configured such that the overlap extension forms a lip seal in a state in which the panel is latched to the second panel.

13. A panel for covering a surface of a room, comprising a panel element extending in a longitudinal direction and a transverse direction for transferring use loads introduced at a top side of the panel element to a bottom side of the panel element facing the surface of the room, wherein the top side is spaced apart from the bottom side in a thickness direction; and a tongue body projecting from the panel element in the longitudinal direction for receiving without play, a locking hook of a second panel which can be latched into a receiving groove formed with the aid of the tongue body and/or the panel element, wherein a tongue end face reference plane of a tongue end face of the tongue body facing away from the panel element extends inclined with respect to the thickness direction, while forming an acute angle with the contact surface of the tongue body facing the locking hook wherein the contact surface of the tongue body merges into the tongue end face via a counter-rounding, and wherein the acute angle $\beta$ is $80° \leq \beta \leq 88°$, and wherein the tongue end face comprises receiving pockets arranged alternately in the thickness direction and extending from the tongue end face reference plane capable of receiving projecting second panel latching bumps of the second panel, and wherein the tongue end face comprises latching bumps projecting from the tongue end face reference plane for engaging into corresponding second panel receiving pockets of the second panel, wherein in at least one cross-sectional plane in the transverse direction the receiving pockets merge directly into the latching bumps only via one inflection point of a cross-sectional profile of the tongue end face lying in the tongue end face reference plane.

14. The panel according to claim 13, wherein the contact surface of the tongue body merges into the tongue end face via a counter-rounding.

15. The panel according to claim 13, wherein the tongue end face comprises an overlap extension projecting from the tongue end face reference plane for covering a joint formed between the tongue end face and the end face of the latched second panel and extending between the overlap extension and the locking hook of the second panel.

16. The panel according to claim 15, wherein the panel element comprises a core and a decorative layer forming the top side and connected to the core, wherein the core and the decorative layer are made of different materials, wherein the overlap extension is formed at least partially from the decorative layer.

17. The panel according to claim 15, wherein the overlap extension is configured such that the overlap extension is pressed against the second panel with a pressing force in a state in which the panel is latched to the second panel.

* * * * *